US006495960B1

(12) United States Patent
Takeji et al.

(10) Patent No.: US 6,495,960 B1
(45) Date of Patent: Dec. 17, 2002

(54) DISCHARGE LAMP

(75) Inventors: Yasaburo Takeji, Kyoto (JP); Shinji Taniguchi, Kyoto (JP); Kuniaki Nakano, Kyoto (JP); Jiro Honda, Kyoto (JP); Shigeyuki Mori, Kyoto (JP)

(73) Assignee: Japan Storage Battery Co., Ltd., Kyoto (JP)

( * ) Notice: Subject to any disclaimer, the term of this patent is extended or adjusted under 35 U.S.C. 154(b) by 0 days.

(21) Appl. No.: 09/959,810

(22) PCT Filed: Mar. 8, 2001

(86) PCT No.: PCT/JP01/01811

§ 371 (c)(1),
(2), (4) Date: Nov. 8, 2001

(87) PCT Pub. No.: WO01/67487

PCT Pub. Date: Sep. 13, 2001

(30) Foreign Application Priority Data

| | | |
|---|---|---|
| Mar. 8, 2000 | (JP) | 2000-063527 |
| Mar. 8, 2000 | (JP) | 2000-063539 |
| May 30, 2000 | (JP) | 2000-160682 |
| May 31, 2000 | (JP) | 2000-163113 |
| May 31, 2000 | (JP) | 2000-163674 |
| Jun. 1, 2000 | (JP) | 2000-164521 |
| Jun. 2, 2000 | (JP) | 2000-165996 |

(51) Int. Cl.[7] ..... H01J 61/30

(52) U.S. Cl. ..... 313/634; 313/493; 313/623; 313/624; 313/625

(58) Field of Search ..... 313/493, 623, 313/624, 625, 634

(56) References Cited

U.S. PATENT DOCUMENTS 5,994,839 A 11/1999 Yamamoto et al. ..... 313/570

FOREIGN PATENT DOCUMENTS

| | | | |
|---|---|---|---|
| JP | 6-196131 | 7/1994 | H01J/61/36 |
| JP | 9-274890 | 10/1997 | H01J/61/36 |
| JP | 10-106491 | 4/1998 | H01J/61/36 |

*Primary Examiner*—Vip Patel
(74) *Attorney, Agent, or Firm*—Sughrue Mion, PLLC

(57) ABSTRACT

An arc tube (6) of discharge lamp comprises a main tube body (11) of translucent ceramic sealed with a terminal plate (13) at both ends thereof. The main tube body (11) comprises integrally a large diameter portion (11A), a tapered portion (11B) which is disposed at both sides of the large diameter portion (11A) and has a smaller diameter toward the forward end thereof, and a small diameter portion (11C) which is connected to the forward end of the tapered portion (11B). In this arrangement, the discharge lamp can be produced more easily than the conventional structure having a narrow portion integrally formed at both ends of a ceramic tube body, making it possible to drastically reduce cost. Further, since a low temperature zone can be only with difficulty formed inside the arc tube during discharge, the luminous efficiency can be raised.

5 Claims, 7 Drawing Sheets

DISCHARGE LAMP

TECHNICAL FIELD

The present invention relates to a discharge lamp comprising a translucent ceramic tube dosed with a metal halide.

BACKGROUND ART

As this kind of a lamp, there is a high pressure discharge lamp as described in Japanese Patent Unexamined Publication No. Hei. 6-196131. As shown in FIG. 8, the arc tube of this lamp comprises a tube body 100 which is made of translucent ceramic such as polycrystalline alumina and is tapered at both ends thereof to form a narrow tube portion 101 at an end thereof, and an electrode lead 103 which is connected to an electrode 102 and inserted in and sealed to the narrow tube portion 101 with a sealing glass 104.

However, this structure has difficulty in providing the arc tube with a higher output. In order to provide a higher output, the diameter of the tube body 100 must be increased to prevent the temperature of the tube body 100 from rising to an abnormally high temperature. This makes the difference in diameter between the tube body 100 and the narrow tube portion 101 too great, making it difficult to produce this structure and causing cracks to occur more easily due to thermal impacts. On the contrary, when the diameter of the narrow tube portion 101 is increased, the gap between the narrow tube portion 101 and the electrode lead 103 increases, adding to the thickness of the sealing glass layer 104 with which they are sealed to each other. Such a sealing glass layer 104 can crack.

As shown in another structure (FIG. 9) described in the above-mentioned patent publication, there is an effective structure comprising a straight tube 105 of translucent ceramic, a ceramic terminal plate 106 fixed at both ends of the straight tube 105, a ceramic narrow tube 107 attached to the terminal plates 106, and an electrode lead 108 inserted in the narrow tube portion 107.

Although this arrangement makes it possible to provide a higher output and makes it easy to produce, a new problem was found that this arrangement gives a lowered luminous efficiency.

The reason for this problem can be thought as follows. In general, the arc tube is dosed with a halide in an amount far more than that required to be vaporized during lighting of lamp. Thus, extra halide left unvaporized is accumulated in a low temperature zone inside the arc tube. When this extra halide is accumulated in the arc tube, emitted light is absorbed by the halide thus accumulated, reducing the amount of light emitted by the arc tube and hence reducing the efficiency of lamp. When the arc tube is actually observed, it is recognized that the poorer the efficiency of the lamp, the more the amount of halide which has been deposited on the lower inner wall of the main tube is lit in a horizontal burning position. Since the structure shown in FIG. 9 comprises the straight tube 105 having the same diameter along the axial length, the temperature is low at the periphery of the both ends of the straight tube 105 (zone A indicated by the shadow). Excess halide left unvaporized resides in these zones to lower the luminous efficiency.

A first object of the invention is to improve the structure of the tube body, making it possible to provide a high output discharge lamp at a low cost. A second object of the invention is to further improve the luminous efficiency.

DISCLOSURE OF THE INVENTION

SUMMARY OF THE INVENTION

The first invention for solving the foregoing problems lies in a discharge lamp comprising an arc tube made of translucent ceramic dosed with a metal halide, and electrodes provided in the arc tube whereby discharge occurs across the electrodes, characterized in that the arc tube comprises a main tube body having integrally a large diameter portion, a tapered portion which is positioned at both ends of the large diameter portion and has a smaller diameter toward the forward end thereof and a small diameter portion which is continuously provided at the forward end of the tapered portion, a terminal plate of ceramic airtightly fitted in and fixed to the interior of the small diameter portion at the both ends of the main tube body, and a narrow tube of ceramic having the terminal plate airtightly inserted and fixed therein, the narrow tube having an electrically-introducing member connected to the electrodes inserted therein and airtightly sealed thereto with a sealing glass.

This arrangement can be produced more easily than the conventional structure having a narrow portion integrally formed at both ends of a ceramic tube body, making it possible to drastically reduce cost. Further, since the tapered portion is disposed at both sides of the large diameter portion of the main tube body so that the main tube body narrows at both ends thereof, a low temperature zone can be only with difficulty formed inside the arc tube during discharge, making it possible to prevent excess unvaporized halide from residing in the low temperature zone and causing the deterioration of luminous efficiency.

The second invention lies in the foregoing invention wherein supposing that the inner diameter of the large diameter portion of the main tube body is A and the inner diameter of the narrow tube is B, A and B satisfy the relationships:

$$B > 1.3 \text{ mm and } 4.5 \leqq A/B \leqq 11.5.$$

In accordance with the present invention, the inner diameter of the narrow tube is not smaller than 1.3 mm, making it possible to use a large electrode and hence provide a discharge lamp with a great power consumption. Further, since supposing that the inner diameter of the large diameter portion is A and the inner diameter of the narrow tube is B, A and B satisfy the relationship $4.5 \leqq A/B \leqq 11.5$, the resulting lamp efficiency is raised. When this numerical value A/B falls within a range of from not smaller than 6 to not greater than 10 ($6 \leqq A/B \leqq 10$), the resulting lamp efficiency is further raised.

Moreover, in accordance with the invention comprising a fitting member, which is made of ceramic sleeve or metal pipe and covers a part of the electrically-introducing member, fitted between the electrically-introducing member and the narrow tube, even if the inner diameter of the narrow tube is not smaller than 1.3 mm, the thickness of the sealing glass layer formed between the electrically-introducing member and the narrow tube can be reduced, making it possible to prevent the crack occurrence of the narrow tube during sealing and hence early leakage of air from the sealing glass layer due to heat cycle developed by switching of lamp on and off.

BEST MODE FOR CARRYING OUT THE INVENTION

<First Embodiment>

Figure 1:
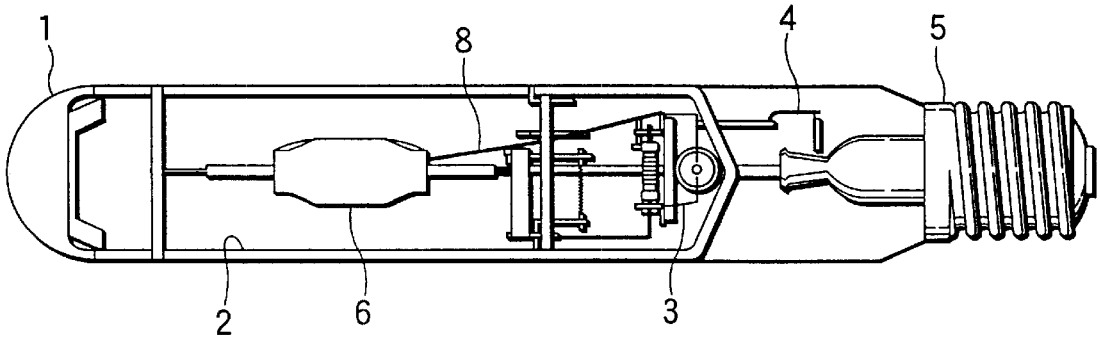
FIG. 1 is a schematic sectional view of discharge lamp illustrating a first embodiment of the present invention.

FIG. 1 illustrates a discharge lamp according to a first embodiment of the present invention. This structure comprises an outer tube 1 of glass having an arc tube 6 supported therein with a supporting flame 2 made of metal rod. In the outer tube 1 are encapsulated a starter 3 for causing the generation of pulse voltage in the outer tube 1 a getter 4, and a metallic ignition aid 8 comprising a metal wire provided along the arc tube 6 to facilitate starting. The outer tube 1 comprises a cap 5 provided at the end thereof.

Figure 2:
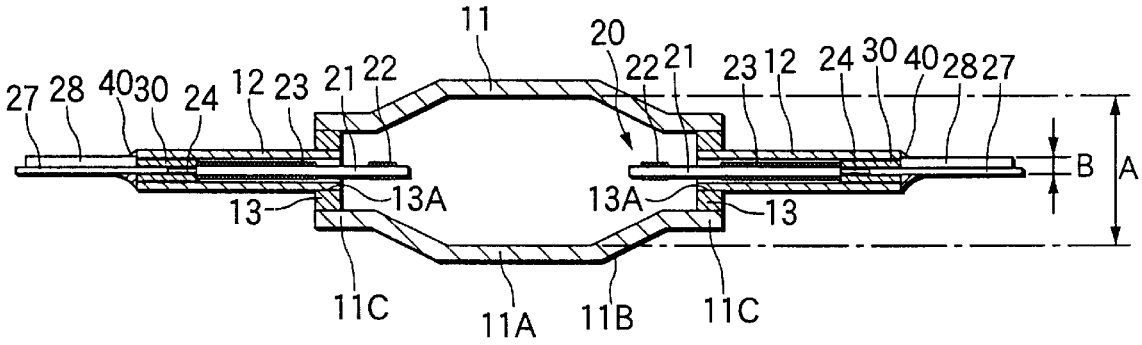
FIG. 2 is a sectional view of an arc tube.
Figure 3:
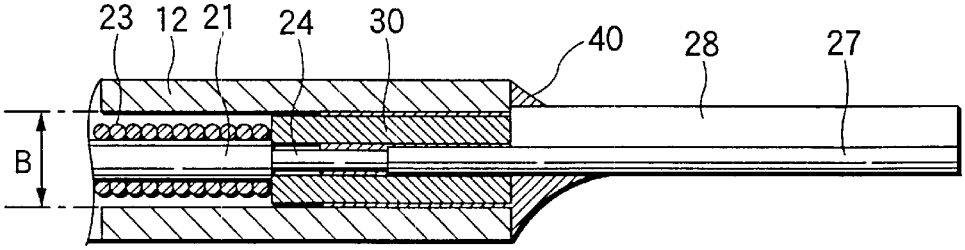
FIG. 3 is an enlarged sectional view of a narrow tube portion.

The structure of the arc tube 6 is shown in detail in FIG. 2. The arc tube 6 comprises a main tube body 11 made of translucent alumina, and a narrow tube 12 attached to the main tube body 11 at both ends thereof with the interposition of a terminal plate 13 formed of translucent alumina. The main tube body 11 comprises integrally a large diameter portion 11A which is formed in a true cylinder having a greater inner and outer diameters than other portions over a predetermined range, a tapered portion 11B which is connected to the large diameter portion 11A at both ends thereof and formed in a cylinder having a smaller diameter toward the forward end thereof, and a small diameter portion 11C which is connected to the forward end of the tapered portion 11B and formed in a true cylinder over a predetermined length. The main tube body 11 is formed, e.g., by extruding alumina clay into a true cylinder, cutting the cylinder into a predetermined size, receiving the cylinder in a mold, blowing pressurized air into the cylinder so that the middle portion thereof is expanded to give a desired form, and then calcining the material.

The terminal plate 13 is in the form of disc. The terminal plate 13 is fitted in and integrally sintered to the smaller diameter portions 11C of the main tube body 11 so that it is airtightly fixed to the main tube body 11. The terminal plate 13 has a through-hole 13A formed at the center thereof. The through-hole 13A has the narrow tube 12 inserted and fixed thereto. The interior of the narrow tube 12 has electrically-introducing members 24 and 27 connected to an electrode 20 and a ceramic sleeve 30 made of translucent alumina, which are airtightly fixed to the narrow tube 12 with a sealing glass 40.

The electrode 20 comprises a first coil 22 wound on the forward end of an electrode core 21 and a second coil 23 wound on the base of the electrode core 21. The first coil 22 extends into the interior of the main tube body 11 from the narrow tube 12. The electrode core 21 of the electrode 20 has the rod-shaped electrically-introducing member 24 butt-welded thereto at the base thereof, and the electrically-introducing member 24 has the rod-shaped electrically-introducing member 27 butt-welded thereto so that the electrically-introducing member 27 extends out of the narrow tube 12. The purpose of the first coil 22 is to protect the electrode 20 against high temperature of arc spot formed at the forward end of the electrode during lighting of lamp. The purpose of the second coil 22 is to allow the heat of the forward end of the electrode to escape to the rear of the electrode and to position the ceramic sleeve 30.

The electrically-introducing member 24 preferably is resistant to heat and halogen and has a thermal expansion coefficient which is not so different from that of the ceramic sleeve 30. As such a material, there may be used molybdenum, molybdenum alloy or cermet, which is a mixture of ceramic and metal. The electrically-introducing member 27 is preferably made of ceramic having heat resistance and making the use of thermal expansion coefficient, i.e., one very close to translucent alumina. As such a material, there may be used niobium, tantalum, niobium alloy or tantalum alloy. The electrically-introducing member 27 has a rod-shaped material 28 welded in parallel thereto for reinforcement and positioning.

By forming the arc tube 6 by the main tube body 11 having the foregoing arrangement, the arc tube 6 can be produced more easily than the conventional structure having a narrow portion integrally formed at both ends of a ceramic tube, making it possible to drastically reduce cost. Further, since the large diameter portion 11A of the main tube body 11 has the tapered portion 11B disposed at both sides thereof so that the main tube body 11 is narrowed at both ends thereof, a low temperature zone can only with difficulty be formed inside the arc tube 6 during discharge, making it possible to prevent excess unvaporized halide from residing in the tow temperature zone and causing the deterioration of luminous efficiency.

A high pressure discharge lamp having a power consumption of 400 W which comprises an arc tube 6 having the structure shown in FIG. 2 will be described hereinafter. The inner diameter A of the large diameter portion 11A of the main tube body 11 is 16 mm, the inner diameter B of the narrow tube 12 at both sides of the large diameter portion 11A is 2.0 mm, and the distance between the electrodes 20 is 23 mm. Accordingly, the value of A/B is 8.

The diameter of the electrode core 21 is 0.9 mm. As the first coil 22, a tungsten wire having a diameter of 0.35 mm is wound on the electrode core 21 by four or five turns. The maximum diameter of the first coil 22 is 1.6 mm. The electrically-introducing member 24 is made of molybdenum and has a diameter of 0.5 mm and a length of 3 mm. The electrically-introducing member 24 is butt-welded to the electrode core 21. An electrically-introducing member 27 made of niobium having a diameter of 0.7 mm is butt-welded to the electrically-introducing member 24 on the side thereof opposite the electrode core 21. The ceramic sleeve 30 is made of alumina and has an inner diameter of 0.75 mm, an outer diameter of 1.9 mm and a length of 6 mm. The rod-shaped element 28 comprises a niobium wire and has a diameter of about 1.0 mm and a length of about 10 mm. The main tube body 11 and the ceramic sleeve 30 are made of the same material, i.e., translucent alumina. The electrically-introducing member 27 is fixed to the interior of the narrow tube with a sealing glass 40 over a length of about 3 mm from the forward end thereof. Under these conditions, the sealing glass 40 fills the gap between the electrically-introducing members 24, 27 and the alumina sleeve 30 and between the alumina sleeve 30 and the narrow tube 12 over a length of about 6 mm from the end of the narrow tube 12. In other words, since the junction of the electrically-introducing members 24 and 27 is covered with the sealing glass 40, the electrically-introducing member 27 is protected against corrosion by halogen. In this embodiment, the thickness of the sealing glass layer 40 corresponds to the gap between the narrow tube 12 and the ceramic sleeve 30 or the gap between the ceramic sleeve 30 and the electrically-introducing members 24, 27, any of which is not greater than 0.2 mm. When the thickness of the sealing glass layer 40 is not greater than 0.2 mm, the resulting sealing structure exhibits excellent heat resistance and thermal impact resistance.

Lamps were then prepared on a trial basis in the same arrangement as mentioned above except that the inner diameter of the main tube body 11 and the narrow tube 12 were changed. The relationship between the inner diameter of the main tube body 11 and the narrow tube 12 and the luminous efficiency of the lamp are summarized in Table 1 below.

The arc tube 6 thus arranged was mounted in a vacuum outer tube 1 to complete a lamp having the same structure as shown in FIG. 1. The characteristics of the lamp developed when it is lit at a power of 400 W in a horizontal burning position were measured. The results are as follows.

Lamp power: 400 W
Lamp current: 3.90 A
Lamp voltage: 133.2 V
Total luminous flux: 38,600 lm
General color rendering index: 90
Color temperature: 3,530 K The lamp was then subjected to life test at a power of 400 W in bare and horizontal burning position. As a result, no abnormalities occurred even after about 6,000 hours of passage.

Lamps were then prepared on a trial basis in the same arrangement as mentioned above except that the inner diameter of the main tube body 11 and the narrow tube 12 were changed. The relationship between the inner diameter of the main tube body 11 and the narrow tube 12 and the luminous efficiency of lamp are summarized in Table 1 below.

TABLE 1

| Inner diameter A of large diameter portion of main tube body (mm) | Inner diameter B of narrow tube (mm) | Inner diameter ratio A/B | Efficiency (lm/W) |
|---|---|---|---|
| 15 | 1.4 | 10.7 | 93 |
| 15 | 1.6 | 9.4 | 95 |
| 15 | 1.8 | 8.3 | 93 |
| 15 | 2 | 7.5 | 92 |
| 16 | 1.4 | 11.4 | 82 |
| 16 | 1.6 | 10 | 99 |
| 16 | 1.8 | 8.9 | 101 |
| 16 | 2 | 8 | 100 |
| 17 | 1.4 | 12.1 | 75 |
| 17 | 1.6 | 10.6 | 91 |
| 17 | 1.8 | 9.4 | 99 |
| 17 | 2 | 8.5 | 101 |
| 17 | 2.2 | 7.7 | 103 |
| 18 | 1.4 | 12.9 | 73 |
| 18 | 1.6 | 11.3 | 85 |
| 18 | 1.8 | 10 | 93 |
| 18 | 2 | 9 | 98 |
| 18 | 2.2 | 8.2 | 97 |

The trial lamps have a constant tube wall load of about 35 W/cm$^2$. Further, when the diameter B of the narrow tube is small, the size of the electrode 20 is reduced to allow the electrode 20 to be inserted in the narrow tube. The efficiency is represented by the value measured when the lamp is lit in a horizontal burning position. As can be seen in Table 1, when A/B is greater than 11.0, the efficiency suddenly drops.

The reason for this phenomenon can be thought as follows. In general, the amount of halide to be dosed in the arc tube is far more than the amount required to be vaporized during lighting of lamp. Thus, extra halide left unvaporized is accumulated in a low temperature zone inside the arc tube. When this extra halide is accumulated in the arc tube, emitted light is absorbed by the halide thus accumulated, reducing the amount of light emitted by the arc tube and hence reducing the efficiency of lamp. When the arc tube 6 was actually observed, it was recognized that the poorer the efficiency of lamp is, the more is the amount of halide which has been deposited on the lower inner wall of the main tube 11 which has been lit in a horizontal burning position. It can thus be thought that a lamp having an A/B value of smaller than 11.0 allows extra halide to be accumulated in the narrow tube, preventing the absorption of light and hence the reduction of efficiency. In practice, the lamps having an A/B value of smaller than 11.0 were found to have little or no halide accumulated in the main tube body 11 of the arc tube 6.

<Second Embodiment>

Figure 4:
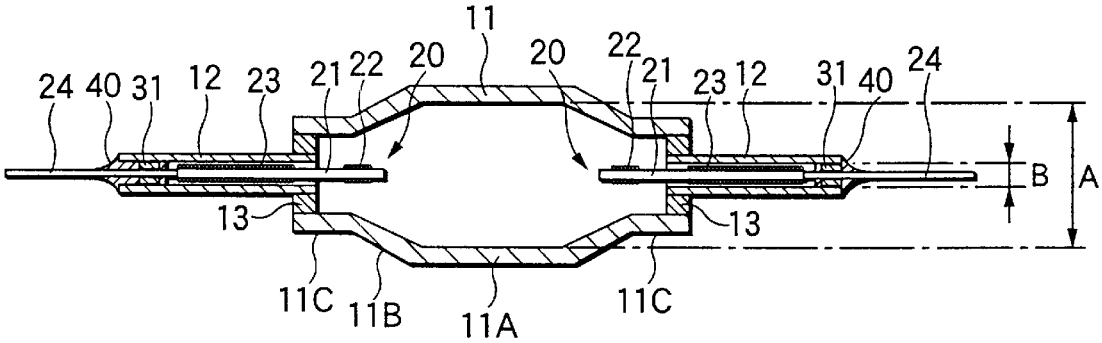
FIG. 4 is a sectional view of arc tube illustrating a second embodiment of the present invention.
Figure 5:
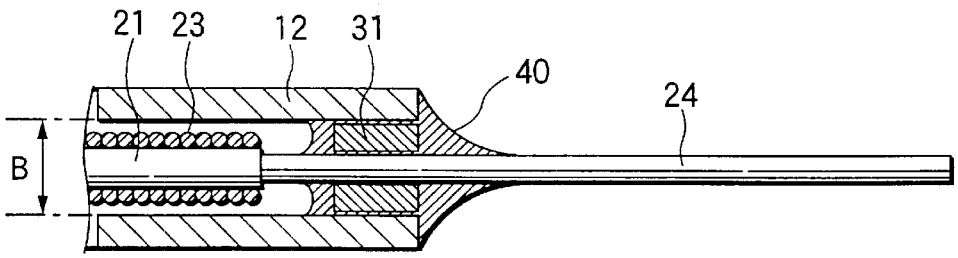
FIG. 5 is an enlarged sectional view of narrow tube portion according to the second embodiment.

FIG. 4 illustrates an arc tube 6 according to a second embodiment of the present invention. The arc tube 6 is different from that according to the first embodiment in that the electrode core 21 is butt-welded to the electrically-introducing member 24 which extends out of the lamp through the narrow tube 12, and a metal pipe 31 as a fitting member is used instead of the foregoing ceramic sleeve 30. The other parts are similar to those in the first embodiment. Like numerals are used for like parts in these embodiments. The electrically-introducing member 24 is made of the same material as in the first embodiment, i.e., molybdenum. The role of the metal pipe 31 is to absorb thermal stress developed between the electrically-introducing member 24 and the sealing glass 40 and between materials of the narrow tube 12 having different thermal expansion coefficients when the lamp is switched on and off. The material of the metal pipe 31 is preferably a soft metal having a thermal expansion coefficient close to that of the narrow tube 12. Preferred examples of such a material include niobium, tantalum, niobium alloy, and tantalum alloy. These materials are desirable particularly when the arc tube is made of translucent alumina.

By forming the arc tube 6 by the main tube body 11 having the foregoing arrangement, the arc tube 6 can be produced more easily than the conventional structure having a narrow portion integrally formed at both ends of a ceramic tube, making it possible to drastically reduce cost. Further, since the large diameter portion 11A of the main tube body 11 has the tapered portion 11B disposed at both sides thereof so that the main tube body 11 is narrowed at both ends thereof, a low temperature zone can only with difficulty be formed inside the arc tube 6 during discharge, making it possible to prevent excess unvaporized halide from residing in the low temperature zone and causing the deterioration of luminous efficiency.

A high pressure discharge lamp having a power consumption of 250 W which comprises an arc tube 6 having the structure shown in FIG. 4 will be described hereinafter. The inner diameter A of the main tube body 11 disposed at the center of the arc tube is 13 mm, the inner diameter B of the narrow tube 12 at both sides of the main tube body 11 is 1.5 mm, and the distance between the electrodes is 18 mm. Accordingly, the value of A/B is 8.067.

The diameter of the electrode core 21 is 0.7 mm. As the first coil 22, a tungsten wire having a diameter of 0.30 mm is wound on the electrode core 2 by four or five turns. The maximum diameter of the first coil 22 is 1.2 mm. The electrically-introducing member 24 is made of molybdenum and has a diameter of 0.5 mm and a length of 20 mm. The electrically-introducing member 24 is butt-welded to the electrode core 21. The metal pipe 31 is made of niobium and has an inner diameter of 0.55 mm, an outer diameter of 1.4 mm and a length of 3 mm. The metal pipe 31 is fixed to the interior of the narrow tube 12 with a sealing glass 40 over a length of about 3 mm from the forward end thereof. The sealing glass 40 fills the gap between the electrically-introducing member 24 and the metal pipe 31 and the gap between the metal pipe 31 and the narrow tube 12 over a length of about 5 mm from the end of the narrow tube 12. Since the metal pipe 31 is thus entirely covered with the sealing glass 40, the metal pipe 31 is protected against corrosion by halogen. In this structure, the thickness of the sealing glass layer 40 corresponds to the gap between the narrow tube 12 and the metal pipe 31 or the gap between the metal pipe 31 and the electrically-introducing member 24, any of which is not greater than 0.2 mm. When the thickness of the sealing glass layer 40 is not greater than 0.2 mm, the resulting sealing structure exhibits excellent heat resistance and thermal impact resistance.

In the arc tube sealed at both sides thereof are dosed about 13 mg of mercury, about 10 mg of dysprosium iodide, about 1 mg of thallium iodide, about 1 mg of sodium iodide, about 1 mg of cesium iodide and about 8 KPa of argon gas as a starting gas.

The arc tube 6 thus arranged was mounted in a vacuum outer tube 1 to complete a lamp having the same structure as in the first embodiment. The characteristics of the lamp developed when it is lit at a power of 250 W in a horizontal burning position were measured. The results are as follows.

Lamp power: 250 W
Lamp current: 2.45 A
Lamp voltage: 117.2 V
Total luminous flux: 25,300 lm
General color rendering index: 85
Color temperature: 4,340 K The lamp was then subjected to life test at a power of 250 W in bare and horizontal burning position. As a result, no abnormalities occurred even after about 6,000 hours of passage.

The lamps of 250 W thus prepared were then subjected to test in the same manner as the lamps of 400 W in the first embodiment that the inner diameter of the main tube body and the narrow tube were changed. The relationship between the inner diameter of the main tube body and the narrow tube and the luminous efficiency of lamp are summarized in Table 2 below. The trial lamps have a constant tube wall load of about 34 W/cm$^2$. Further, when the diameter of the narrow tube is small, the size of the electrode is reduced to allow the electrode to be inserted in the narrow tube. The efficiency is represented by the value measured when the lamp is lit in a horizontal burning position.

TABLE 2

| Inner diameter A of large diameter portion of main tube body (mm) | Inner diameter B of narrow tube (mm) | Inner diameter ratio A/B | Efficiency (Im/W) |
|---|---|---|---|
| 12 | 2.2 | 5.5 | 86 |
| 15 | 3 | 5 | 83 |
| 12 | 1.7 | 7.1 | 93 |
| 12 | 1.9 | 6.3 | 92 |
| 13 | 1.3 | 10 | 86 |
| 13 | 1.5 | 8.7 | 93 |
| 13 | 1.7 | 7.6 | 92 |
| 13 | 1.9 | 6.8 | 93 |
| 14 | 1.3 | 10.8 | 82 |

TABLE 2-continued

| Inner diameter A of large diameter portion of main tube body (mm) | Inner diameter B of narrow tube (mm) | Inner diameter ratio A/B | Efficiency (Im/W) |
|---|---|---|---|
| 14 | 1.5 | 9.3 | 87 |
| 14 | 1.7 | 8.2 | 89 |
| 14 | 1.9 | 7.4 | 88 |
| 15 | 1.3 | 11.5 | 68 |
| 15 | 1.5 | 10 | 86 |
| 15 | 1.7 | 8.8 | 89 |
| 15 | 1.9 | 7.9 | 91 |

As can be seen in Table 2, when A/B is greater than 11.0, the efficiency suddenly drops. The reason for this phenomenon can be thought the same as described with reference to 400 W.

Figure 6:
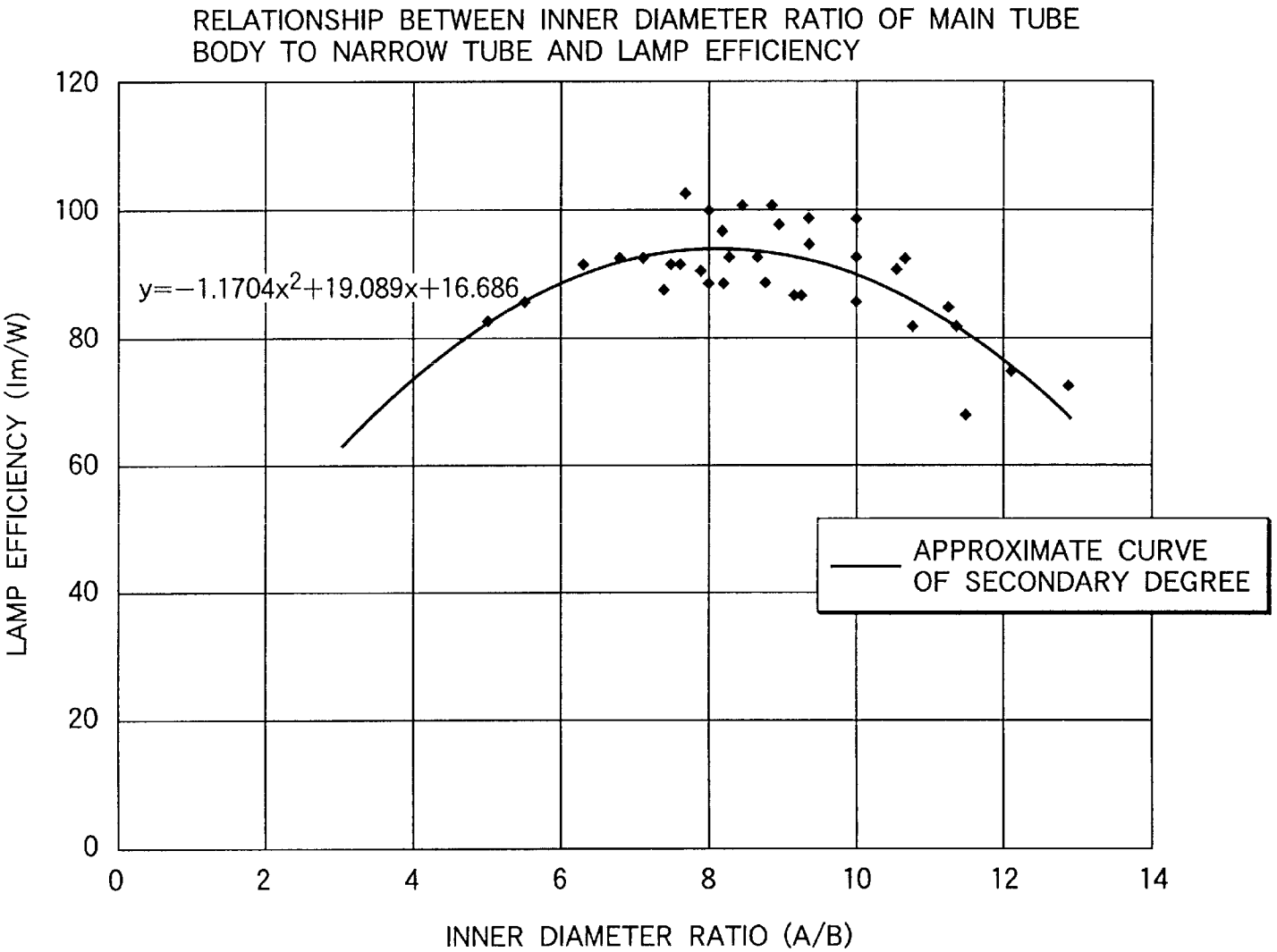
FIG. 6 is a graph illustrating the relationship between the ratio of inner diameter and the lamp efficiency.

The foregoing results of Tables 1 and 2 are graphically represented in FIG. 6 with A/B as a parameter. An approximate curve of secondary degree can be drawn from this graph as shown in FIG. 6. As can be seen in these results, the preferred range of inner diameter ratio A/B where the lamp efficiency is not smaller than 80 lm/W is from 4.5 to 11.5, and the preferred range of inner diameter ratio A/B where the lamp efficiency is 90 lm/W is from 6 to 10.

<Third Embodiment>

Figure 7:
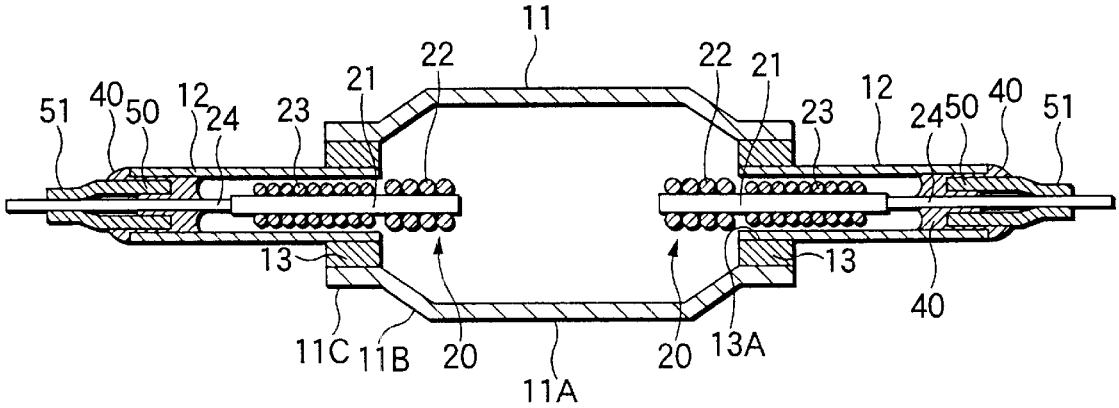
FIG. 7 is a sectional view of arc tube illustrating a third embodiment of the present invention.
Figure 8:
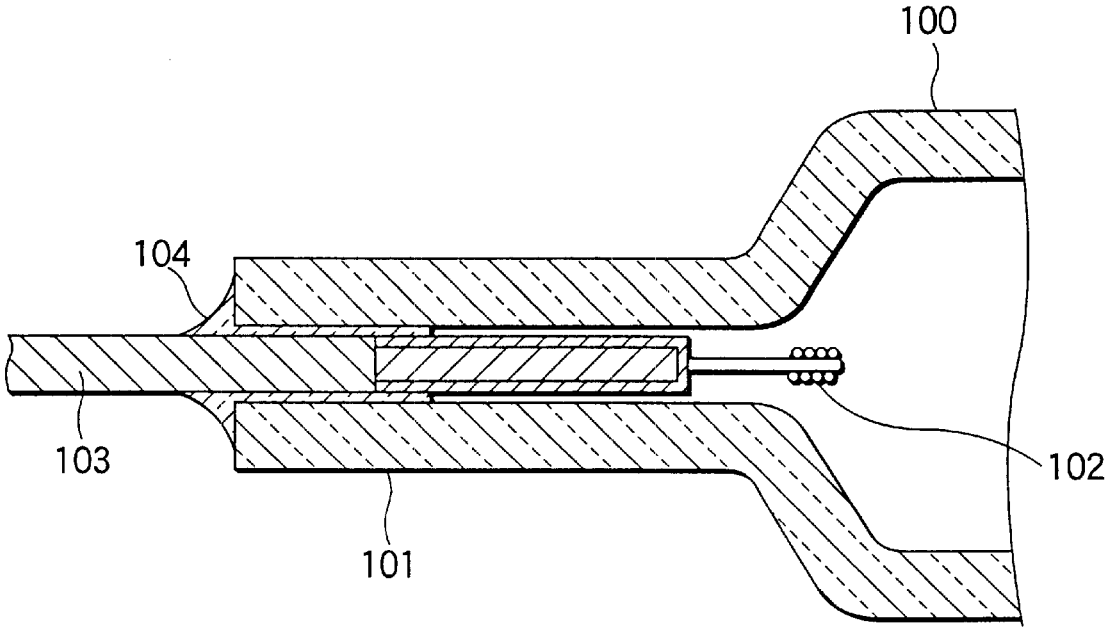
FIG.8 PRIOR ART
FIG. 8 is a partial sectional view illustrating an example of conventional arc tube.
Figure 9:
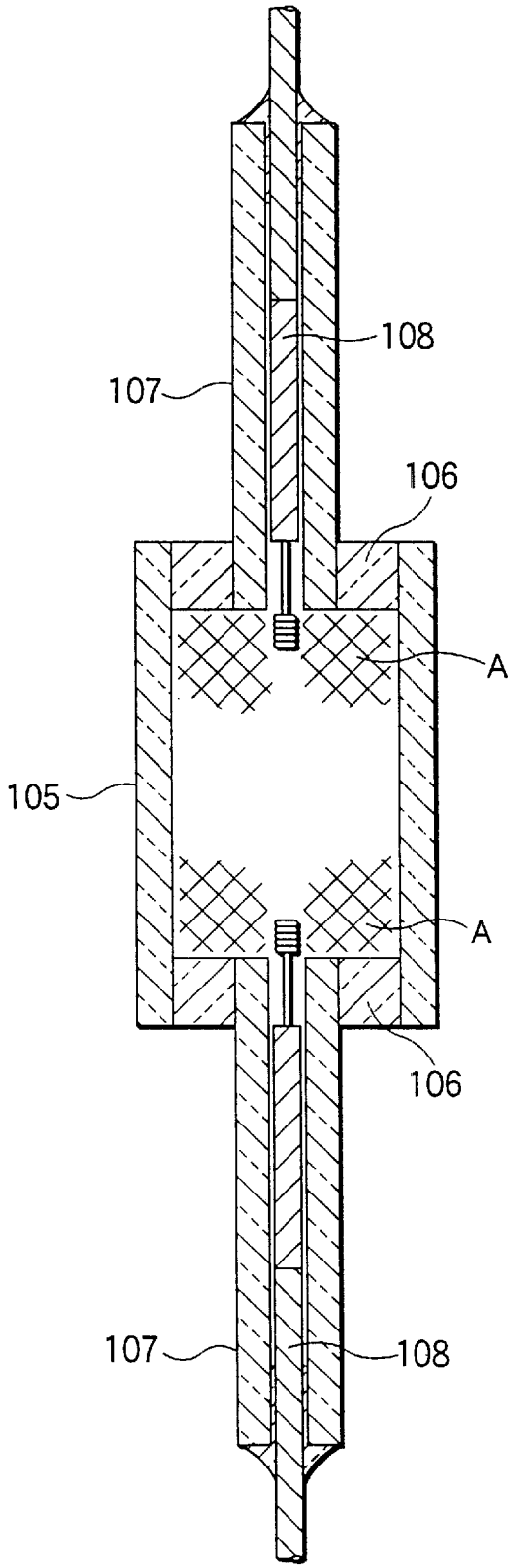
FIG.9 PRIOR ART
FIG. 9 is a sectional view illustrating another example of conventional arc tube.

A third embodiment of the present invention is shown in FIG. 7. The third embodiment is different from the foregoing second embodiment in the fixing structure of the metal pipe 50 as a fitting member. Similarly to the foregoing each embodiment, the main tube body 11 comprises integrally a large diameter portion 11A which is formed in a true cylinder having a greater inner and outer diameters than other portions over a predetermined range, a tapered portion 11B which is connected to the large diameter portion 11A at both ends thereof and formed in a cylinder having a smaller diameter toward the forward end thereof, and a small diameter portion 11C which is connected to the forward end of the tapered portion 11B and formed in a true cylinder over a predetermined length. A terminal plate 13 is in the form of disc. The terminal plate 13 is fitted in and integrally sintered to the smaller diameter portions 11C of the main tube body 11 so that it is airtightly fixed to the main tube body 11. The terminal plate 13 has a through-hole 13A formed at the center thereof. The through-hole 13A has a narrow tube 12 of translucent alumina inserted and fixed thereto. The interior of the narrow tube 12 has a rod-shaped electrically-introducing member 24 butt-welded to an electrode core 21 of an electrode 20.

The electrically-introducing member 24 has the metal pipe 50 as a fitting member fitted thereon. The metal pipe 50 is caulked and press-bonded to the electrically-introducing member 24 at the end thereof opposite the electrode 20. There is formed a gap between the metal pipe 50 and the electrically-introducing member 24 at the area other than a pressure-bonded area 51. The foregoing gap and the gap between the metal pipe 50 and the inner surface of the narrow tube 12 are filled with a sealing glass 40. This structure is advantageous in that the metal pipe 50 can be easily positioned by caulking.

This embodiment can be produced more easily than the conventional structure having a narrow portion integrally formed at both ends of a ceramic tube body, making it possible to drastically reduce cost. Further, since the tapered portion is disposed at both sides of the large diameter portion of the main tube body so that the main tube body narrows at both ends thereof, a low temperature zone can be only with difficulty formed inside the arc tube during discharge, making it possible to prevent excess unvaporized halide from residing in the low temperature zone and causing the deterioration of luminous efficiency.

Industrial Applicability

In accordance with the invention, the discharge lamp can be produced more easily than the conventional structure having a narrow portion integrally formed at both ends of a translucent ceramic tube, making it possible to drastically reduce cost. Further, since the tapered portion is disposed at both sides of the large diameter portion of the main tube body so that the main tube body narrows at both ends thereof, a low temperature zone can be difficultly formed inside the arc tube during discharge, making it possible to prevent excess unvaporized halide from residing in the low temperature zone and causing the deterioration of luminous efficiency.

What is claimed is:

1. A discharge lamp comprising:

an arc tube made of translucent ceramic dosed with a metal halide; and electrodes provided in said arc tube whereby discharge occurs across said electrodes, wherein said arc tube comprises:

a main tube body having integrally a large diameter portion, a tapered portion which is positioned at both ends of said larger diameter portion and a small diameter portion which is continuously provided at an end of each of said tapered portions, a terminal plate of ceramic airtightly fitted in and fixed to the interior of each of the small diameter portions at the both ends of said main tube body, and a narrow tube of ceramic airtightly inserted and fixed within each of the terminal plates, wherein each of said narrow tubes has an electrically-introducing member connected to said electrodes inserted therein and airtightly sealed thereto with a sealing glass, wherein said sealing glass is provided on an exterior of a free end of said narrow tube.

2. The discharge lamp according to claim 1, wherein an inner diameter of the large diameter portion of the main tube body is A and an inner diameter of the narrow tube is B, and A and B satisfy the relationships:

$$B > 1.3 \text{ mm and } 4.5 \leqq A/B \leqq 11.5.$$

3. The discharge lamp according to claim 1, wherein an inner diameter of the large diameter portion of the main tube body is A and an inner diameter of the narrow tube is B, and A and B satisfy the relationships:

$$B > 1.3 \text{ mm and } 6 \leqq A/B \leqq 10.$$

4. The discharge lamp according to any of claims 1 to 3, wherein a fitting member made of ceramic sleeve or metal pipe for covering at least a part of said electrically-introducing member is fitted in between said electrically-introducing member and said narrow tube.

5. The discharge lamp according to claim 4, wherein a gap between an inner surface of said fitting member and said electrically-introducing member and a gap between an outer surface of said fitting member and said narrow tube are filled with said sealing glass.

* * * * *